US006669492B1

(12) United States Patent
McIlvenna

(10) Patent No.: US 6,669,492 B1
(45) Date of Patent: Dec. 30, 2003

(54) SAFETY COVER FOR AN ELECTRICAL OUTLET

(76) Inventor: Ryan McIlvenna, 3094 Marie Ave., Val Caron, Ontario (CA), P3N 1C3

( * ) Notice: Subject to any disclaimer, the term of this patent is extended or adjusted under 35 U.S.C. 154(b) by 0 days.

(21) Appl. No.: 10/271,736

(22) Filed: Oct. 17, 2002

(51) Int. Cl.[7] ..... H01R 13/44
(52) U.S. Cl. ..... 439/135
(58) Field of Search ..... 439/135, 136, 439/147, 142; 74/66, 67

(56) References Cited

U.S. PATENT DOCUMENTS 5,240,426 A * 8/1993 Barla ..... 439/136
5,362,924 A * 11/1994 Correnti ..... 174/67
5,382,755 A * 1/1995 Correnti ..... 174/67
5,389,740 A * 2/1995 Austin ..... 174/67
6,501,022 B2 * 12/2002 Victor ..... 174/66

* cited by examiner

*Primary Examiner*—Lynn Feild
*Assistant Examiner*—Thanh-Tam Le
(74) *Attorney, Agent, or Firm*—Mike M. Gauthier

(57) ABSTRACT

A device relating to a child safety cover for an electrical outlet whereby access to said outlet is restricted to children while the outlet may remain in use comprising; a base having one or more openings through which an electrical outlet is placed, cover-engaging vertical slide channels near both side edges of the base, a locking latch located near the lower inner surface of each outer edge of the base, a cover having a top, two side and front portions, base-engaging channels adapted to slide vertically and longitudinally within the base channels, strikes for receiving each base latch whereby as the cover is slidably engaged within the base channels. The cover locks in place until both side portions of the cover are depressed inwardly thereby disengaging the latch and strike allowing freedom to slide the cover upwardly to gain access to the outlet.

9 Claims, 6 Drawing Sheets

9
3
2
9
10
7
4
12
11
7
10
14
8
13
6

SAFETY COVER FOR AN ELECTRICAL OUTLET

FIELD OF THE INVENTION

The present invention relates to a child safety cover for an electrical outlet whereby access to said outlet is restricted to children while the outlet may remain in use. The child safety cover of the present invention comprises; a base having one or more openings through which the normally exposed portion of an electrical outlet is placed, one or more perforations for outlet-attaching screws, cover-engaging vertical female channels near both side edge of the base and a downwardly and outwardly tapered opening in said channel from the channel portion to the frontal surface of the base thereby forming a generally vertically T-shaped void within the base from the upper to lower edge, a plurality of cone-shaped nipples protruding from the rear surface of the base so as to slightly penetrate an adjacent wall surface thereby preventing the child safety cover from rotational displacement, a locking latch located near the lower inner surface of the outwardly tapered opening proximal to each outer edge of the base, a primary cover having a top, two side and front portions wherein each portion is integral to one another and made of a resilient sheet material thereby forming a generally rectangular cube exempt of a back and a bottom, base-engaging channels at each rear-most side edges of the primary cover adapted to slide vertically and longitudinally within the channels within the base, strikes for receiving each base latch whereby as the primary cover is slidably engaged within the base channels, a secondary cover for covering the outlet when not in use having a top, a front and two side portions wherein each portion is integral to one another and made of a resilient sheet material thereby forming a generally hollow rectangular cube exempt of a back and a bottom, base-engaging channels at each rear-most side edges of the secondary cover adapted to slide vertically and longitudinally within the channels within the base, strikes for receiving each base latch whereby as the secondary cover is slidably engaged within the base channels, the base engaging portions of the lower side portions of the secondary cover ramps inwardly against the base lacking latch until such a time when the upper inner surface of the secondary cover contacts the upper edge of the base and the locking latches and strikes align to allow the sides of the secondary cover to spring outwardly thereby snapping the latched into the mating strikes. Either primary or secondary covers are then locked in place until both side portions of the cover are depressed inwardly thereby disengaging the latch and strike allowing freedom to slide respective cover upwardly to gain access to the outlet.

BACKGROUND OF THE INVENTION

Household electrical outlets present grave danger to infants and young children alike. Countless children are either injured or killed due to electrical outlet related accidents and since these outlets are necessary to the household, disabling the outlets is not a practical solution. One must rely on deterrents to keep children safe from the dangers that outlets could present.

It is desirable for parents and guardians of children to deny the children access to electrical outlets while it is equally desired to maintain usage of said outlets.

The applicant is aware of several attempts in prior art to provide means of denying children access to electrical outlets while maintaining usage of said outlets. For example, reference may be had to U.S. Pat. No. 3,428,936 of Arnoa, issued Nov. 18, 1969, which describes a plug terminal cover assembly designed to encase said plug within a housing adapted to be accessible only by unscrewing a hinged portion of the housing. The device fails to allow for larger transformer-type plugs to be used in this device. Furthermore, this invention has little aesthetic value.

Another example of prior art may be had in referring to U.S. Pat. No. 3,601,757 of Gober, issued Aug. 24, 1971, which depicts a split male threaded retainer adapted to house the plug end within a cavity in a female threaded retainer faceplate. Such an arrangement prohibits the use of larger transformer-type plugs to be used. Additionally, each retainer consists of a plurality of components thereby encouraging possible loss of some of these components.

Another example may be had in referring to U.S. Pat. No. 4,070,078 of Chrones, issued Jan. 24, 1978, which teaches of a pair of hinged covers adapted to snap in place after inserting a plug into the outlet. The cover presents only a minor challenge to open therefore deterring access from children to more limited age. Again, this invention fail to provide sufficient space to use larger transformer-type plugs.

While these and other attempts have been made to provide means for parents and guardians of children to deny children access to electrical outlets while maintaining usage of said outlets, none of these inventions in prior art allow for ease of use for adults, provisions for larger transformer-type plugs to be used, and an aesthetically pleasing appearance.

SUMMARY OF THE INVENTION

It is thus the object of the present invention to provide means for parents and guardians of children to deny children access to electrical outlets while maintaining usage of said outlets, allow for ease of use for adults, provide sufficient space for larger transformer-type plugs to be used, and be aesthetically pleasing in appearance.

In one aspect of the invention, there is provided a plurality of removable wall-penetrating nipples.

In another aspect of the invention, the outlet openings may be adapted for the various outlet shapes and configurations.

In another aspect of the invention, a secondary cover having a thin profile is provided so as to be utilized only to cover the outlet when not in use.

Accordingly, the device of the present provide means for parents and guardians of children to deny children access to electrical outlets while maintaining usage of said outlets, allow for ease of use for adults, provisions for larger transformer-type plugs to be used, and an aesthetically pleasing appearance.

The utility of this device includes but is not limited to outlets.

BRIEF DESCRIPTION OF THE DRAWINGS

These and other advantages of the invention will become apparent upon reading the following detailed description and upon referring to the drawings in which.

Figure 1:
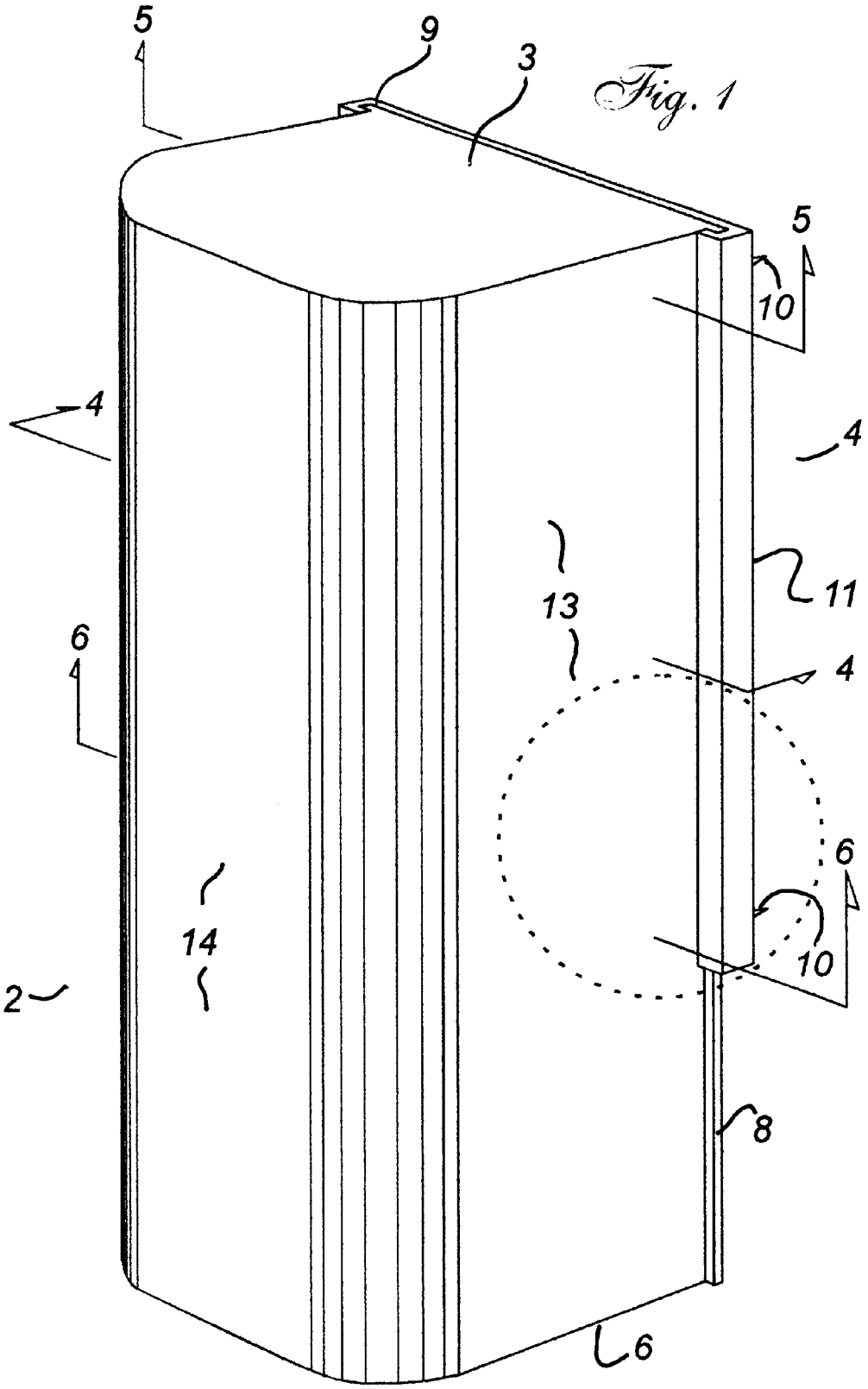
FIG. 1 is a perspective view from above of the safety cover for an electrical outlet of the present invention adapted with the primary cover.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENT

In the following description, similar features in the drawings have been given similar reference numerals.

Turning to the drawings, in particular, FIG. 1 which illustrates an embodiment of a safety cover for an electrical outlet comprising; a base 4 having cover-engaging vertical slide channels 9 near both side edge of the base 4 having a depth substantially lesser than the thickness of the base material and generally centered within the thickness of said base and a downwardly and outwardly tapered opening in said channel from the channel portion to the frontal surface of the base 4 thereby forming a generally vertically T-shaped void within the base 4 from the upper to lower edge, a plurality of cone-shaped nipples 10 protruding from the rear surface 11 of the base 4 so as to slightly penetrate an adjacent wall surface thereby preventing the child safety cover from rotational displacement, a primary cover 2 having a top 3, two side 13 and front 14 portions wherein each portion 3, 13 and 14 are integral to one another and made of a resilient sheet material thereby forming a generally rectangular cube exempt of a back and a bottom, base-engaging channels 8 at each rear-most side edges of the primary cover 2 adapted to slide vertically and longitudinally within the channels 9 within the base 4.

Figure 2:
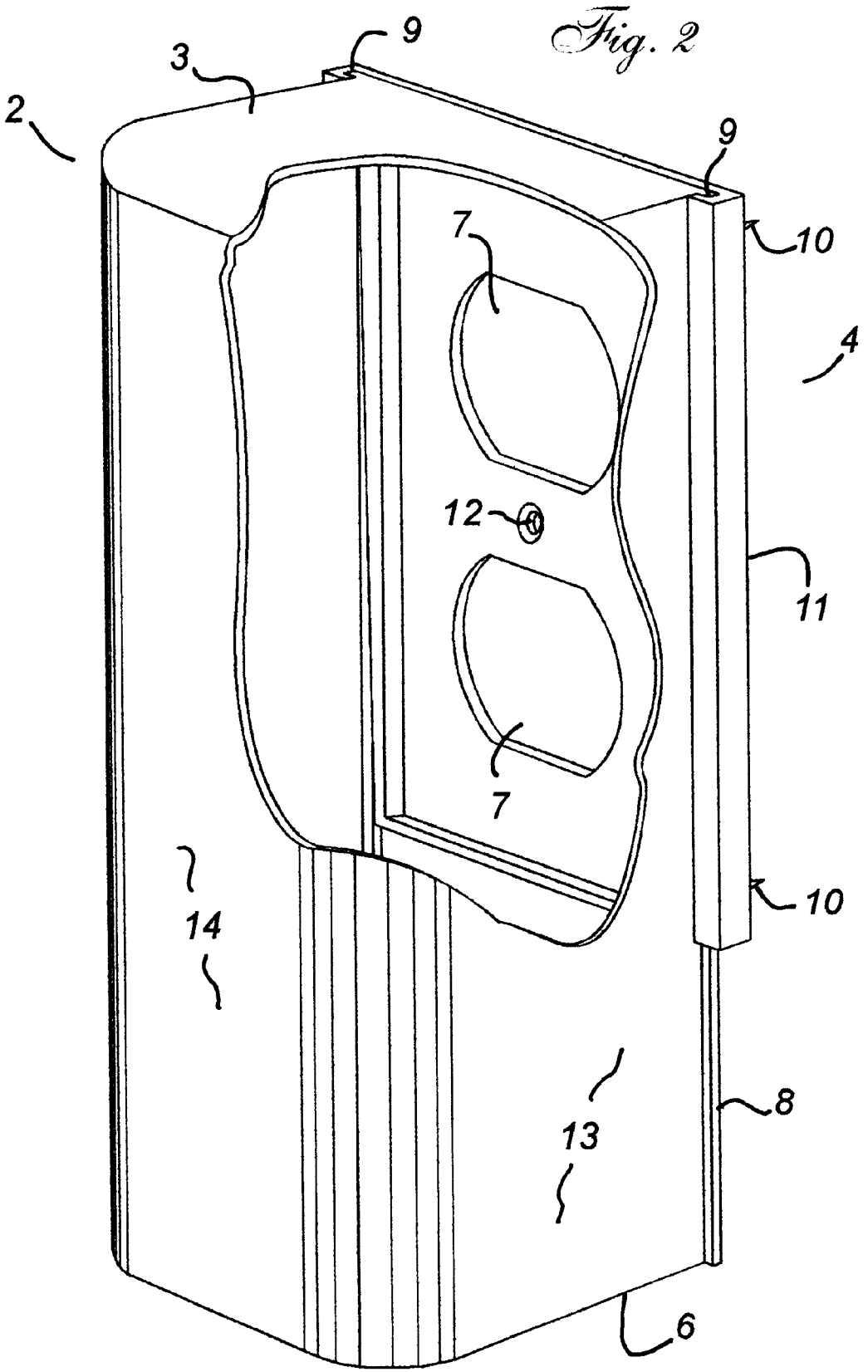
FIG. 2 is a partially transparent perspective view from above of the primary cover of the safety cover for an electrical outlet of the present invention.

Referring now to FIG. 2, a perspective view from above of the safety cover for an electrical outlet of the present invention illustrating the primary cover 2 in a partially transparent manner in order to further depict the relationship between the base 4 and said primary cover 2. The base 4 is adapted with suitable outlet openings 7 so as to accept the normally protruding portion of an electrical outlet, and a secondary perforation 12 adapted to align with the female treaded plate-attaching portion of a conventional electrical outlet, a plurality of cone-shaped nipples 10 protruding from the rear surface 11 of the base 4 so as to slightly penetrate an adjacent wall surface thereby preventing the child safety cover from rotational displacement.

Figure 3:
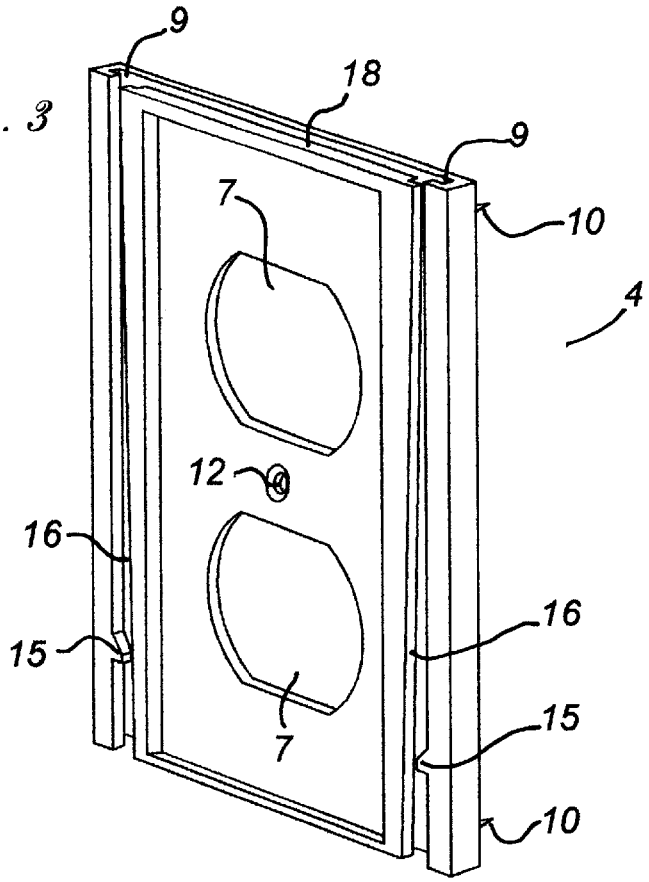
FIG. 3 is a perspective view from above of the base portion of the safety cover for an electrical outlet of the present invention.

Referring now to FIG. 3, a perspective view from above of the base portion 4 of the safety cover for an electrical outlet of the present invention wherein female channels 9 are illustrated. Said channels 9 are located near both side edge of the base 4 having a depth substantially lesser than the thickness of the base material and generally centered within the thickness of said base 4 and a downwardly and outwardly tapered opening 16 in said channels 9 from the channel portion to the frontal surface of the base 4 thereby forming a generally vertically T-shaped void within the base 4 from the upper to lower edge of said base 4, outlet openings 7 adapted to accept the normally protruding portion of an electrical outlet, and a secondary perforation 12 adapted to align with the female treaded plate-attaching portion of a conventional electrical outlet, a plurality of cone-shaped nipples 10 protruding from the rear surface 11 of the base 4 so as to slightly penetrate an adjacent wall surface thereby preventing the child safety cover from rotational displacement, locking latches located near the lower inner surface of the outwardly tapered opening 16 proximal to each outer edge of the base 4. The upper surface of each latch 15 is tapered downwardly and inwardly so as to create an inward ramp effect when the lower edge of the primary cover 2 abuts said latch 15. The upper edge of the base 4 is provided with a dropped partial edge 18 where the lower surface of the top of the primary cover 2 shall positively stop, preventing the primary cover 2 from continuing downwardly.

Figure 4:
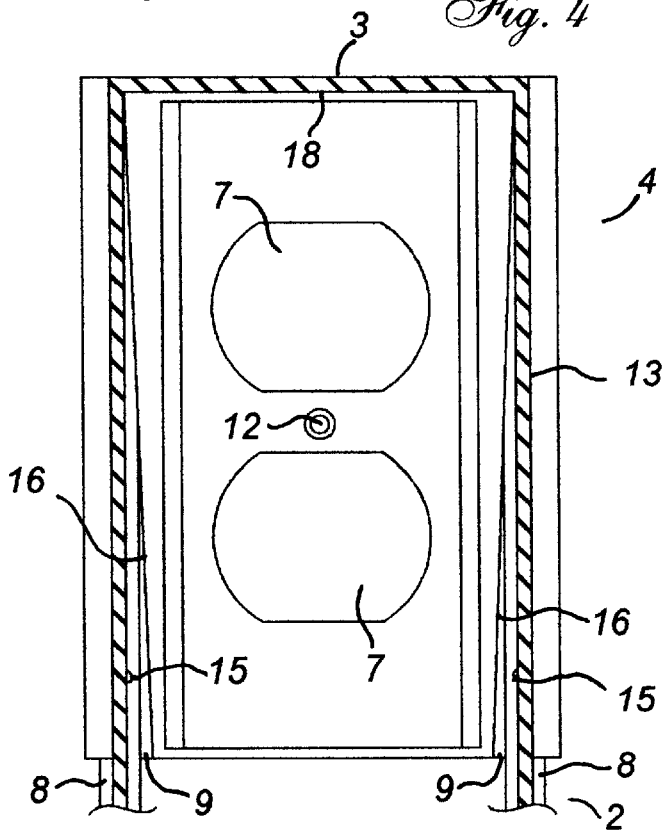
FIG. 4 is a front cross-sectional view of FIG. 1 of the safety cover for an electrical outlet of the present invention.

Turning to FIG. 4, a front cross sectional view of FIG. 1 of the safety cover for an electrical outlet of the present invention illustrating the portion of the primary cover 2 as positioned in a relaxed state within the vertical female channel 9 of the base 4 wherein the male channels 8 of the primary cover 2 are longitudinally engaged within the vertical female channels 9 of the base 4 and the lower surface of the top portion 3 of the primary cover abuts the dropped partial edge 18 of the base 4.

Figure 5:
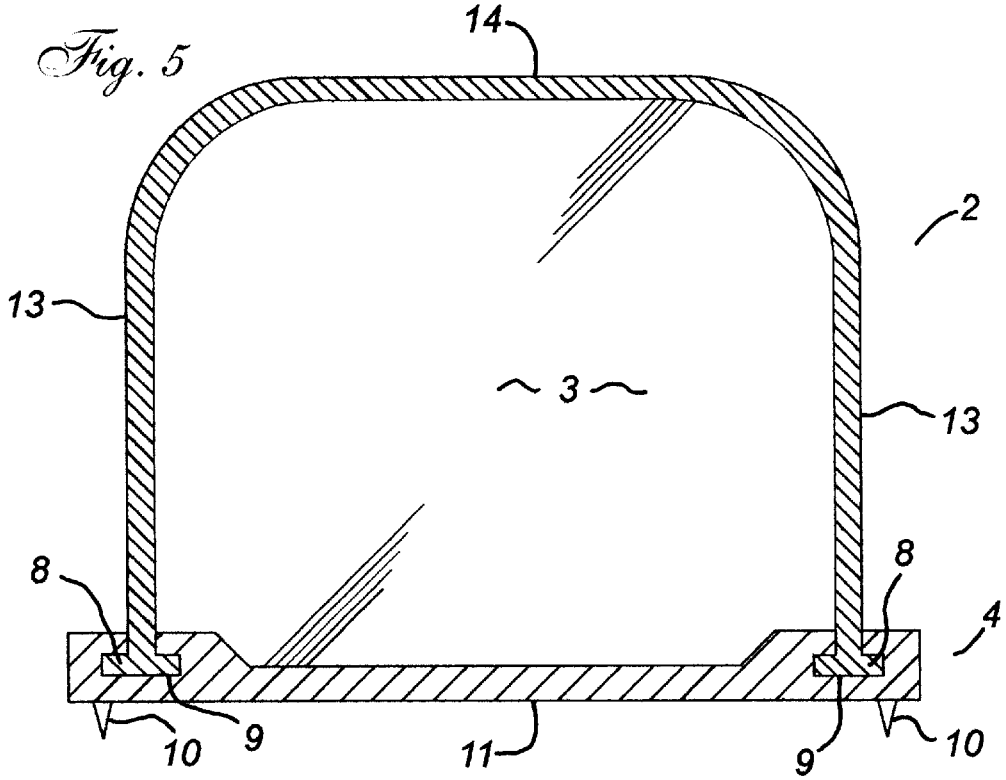
FIG. 5 is a cross-sectional view from below of FIG. 1 of the safety cover for an electrical outlet of the present invention adapted with the primary cover in a relaxed state.
Figure 6:
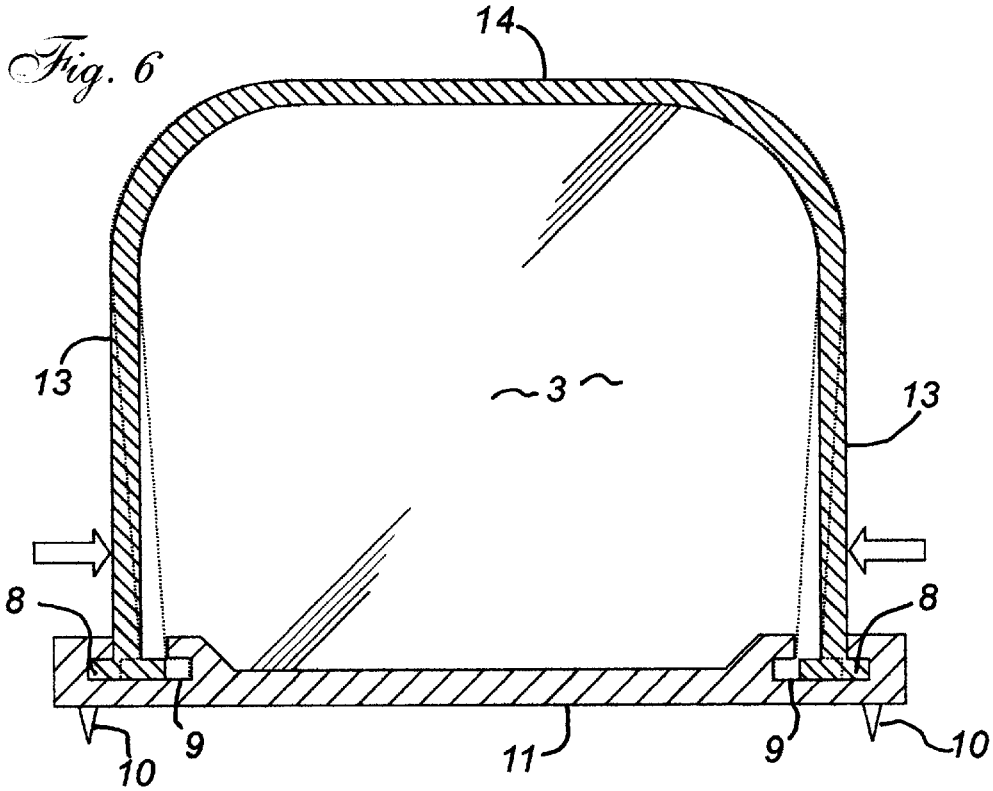
FIG. 6 is a cross-sectional view from below of FIG. 1 of the safety cover for an electrical outlet of the present invention adapted with the primary cover in a compressed state.

In reference now to FIGS. 5 and 6, both cross-sectional views of FIG. 1 wherein FIG. 5 illustrates that the vertical female channels 9 at the top portion of the base 4 are more narrow than at the lower portion of the base 4 as shown in FIG. 6 whereby the top portion of the female channels 9 restricts lateral movement of the male channels 8 and the lower portion of said female channel 9 permits inward lateral movement thereby allowing the disengagement of the latch and strike.

Figure 7:
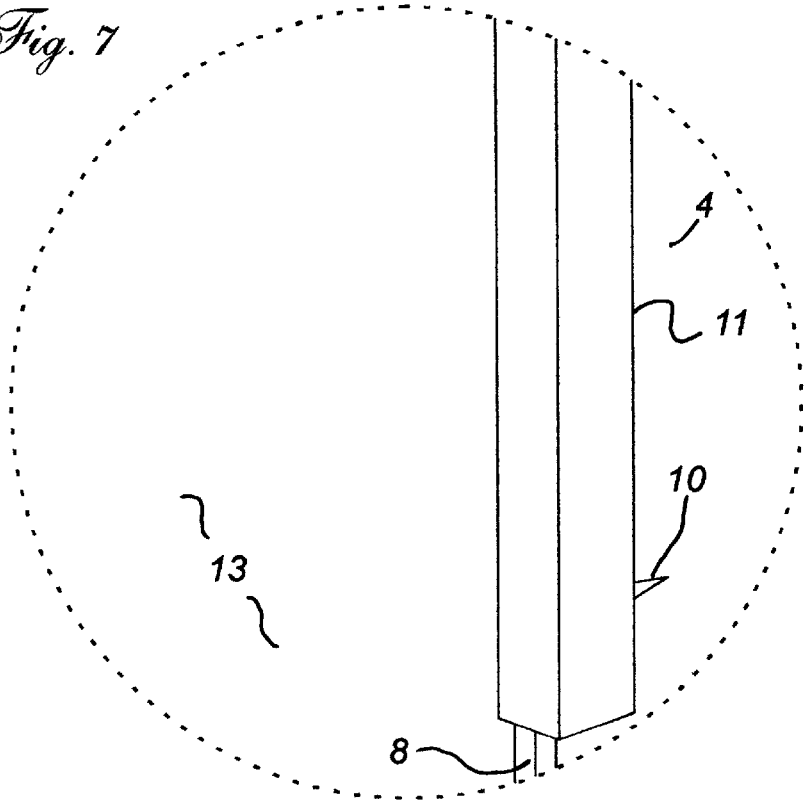
FIG. 7 is an enlarged view from of a selected portion of FIG. 1 of the safety cover for an electrical outlet of the present invention with the primary cover in a relaxed state.
Figure 8:
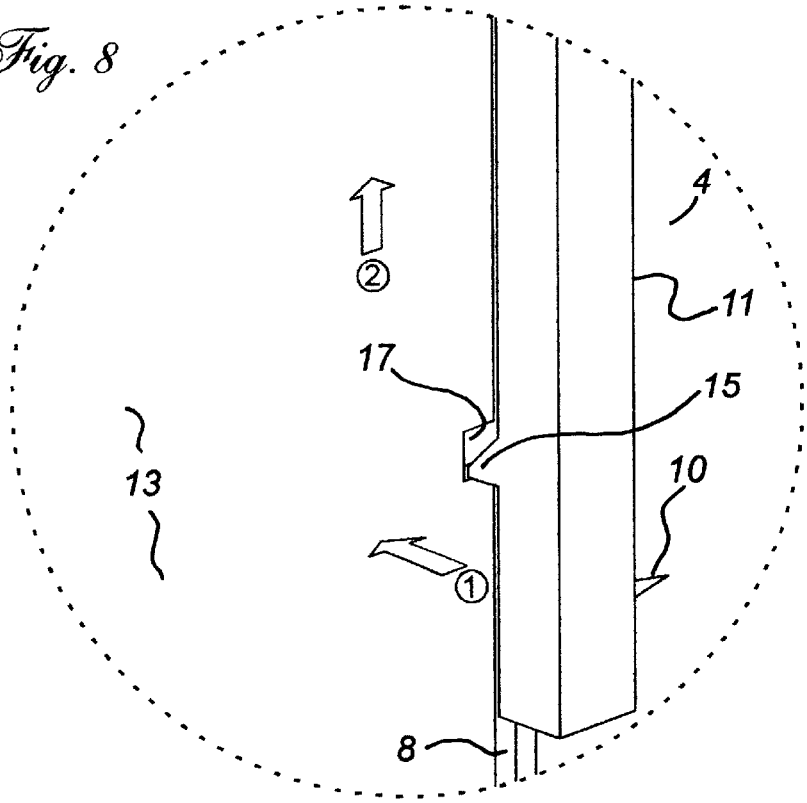
FIG. 8 is an enlarged view from of a selected portion of FIG. 1 of the safety cover for an electrical outlet of the present invention with the primary cover in a compressed state.

Referring now to FIGS. 7 and 8, both are enlarged views from of a selected portion of FIG. 1 of the safety cover for an electrical outlet of the present invention illustrating FIG. 7 with the primary cover 2 in a relaxed state, and FIG. 8 with the primary cover 2 in a compressed state. The arrows in FIG. 8 depict the sequence necessary to enable the primary cover to be displaced vertically and longitudinally along the vertical female channels 9 within the base 4. Therefore, by inwardly compressing (1) the sides 13 of the primary cover 2, then sliding the primary cover upwardly (2), the primary cover is thereby freed from its locked position and able to be removed from the base 4 for access to the outlet.

Figure 9:
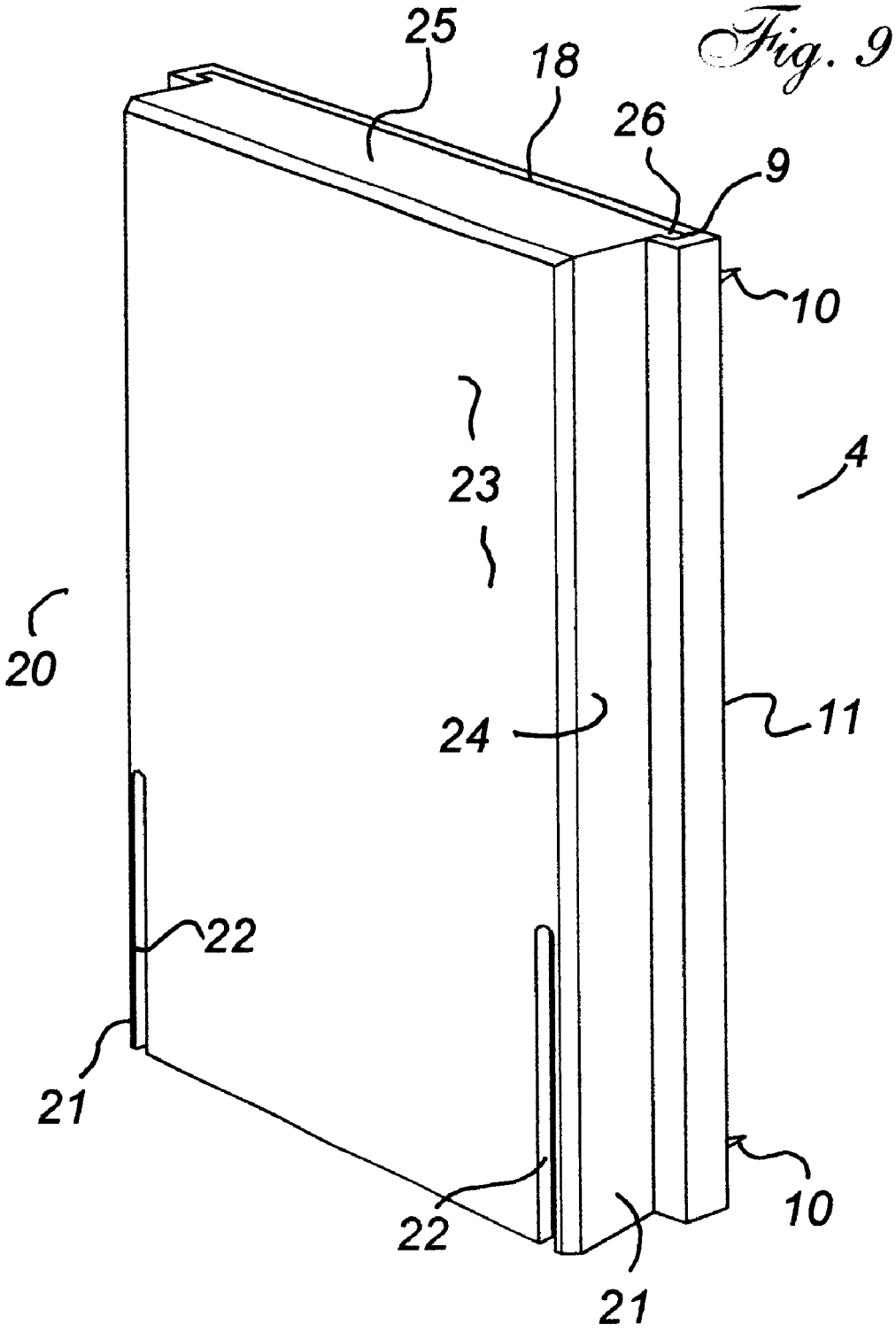
FIG. 9 is a perspective view from above of the safety cover for an electrical outlet of the present invention adapted with the secondary cover.

Turning now to FIG. 9, a perspective view from above of the safety cover for an electrical outlet of the present invention adapted with the secondary cover 20. The secondary cover 20 comprises; a top 25, two side 24 and front 23 portions wherein each portion 25, 24 and 23 are integral to one another and made of a resilient sheet material thereby forming a generally rectangular planar cube exempt of a back and a bottom, base-engaging channels 26 at each rear-most side edge 24 of the secondary cover 20 adapted to slide vertically and longitudinally within the channels 9 in the base 4, strike tabs 21 provided by the removal of vertical grooves 22 so as to allow the strike tabs 21 to flexibly displace inwardly while closing the groove 22 and unlocking the strike 17 and latch 15 as depicted in FIG. 8. Therefore, as the secondary cover is slidably engaged within the base channels 9, the base engaging portions 26 of the lower side portions of the secondary cover 20 ramps inwardly against the base locking latch until such a time when the upper inner surface of the secondary cover 20 contacts the upper edge of the base 4 and the locking latches and strikes align to allow the sides of the secondary cover 20 to spring outwardly thereby snapping the latched into the mating strikes. The secondary cover 20 provides users with an alternative to using the large primary cover 2 when the outlet is not in use.

What is claimed is:

1. A safety cover for an electrical outlet comprising:

a. a base having one or more openings through which the normally exposed portion of an electrical outlet is placed, one or more perforations for outlet-attaching screws, cover-engaging vertical female channels near both side edge of the base having a depth substantially lesser than the thickness of the base material and generally centered within the thickness of said base and a downwardly and outwardly tapered opening in said channel from the channel portion to the frontal surface of the base thereby forming a generally vertically T-shaped void within the base from the upper to lower edge, a plurality of cone-shaped nipples protruding from the rear surface of the base so as to slightly penetrate an adjacent wall surface thereby preventing the child safety cover from rotational displacement, a locking latch located near the lower inner surface of the outwardly tapered opening proximal to each outer edge of the base, b. a primary cover having a top, a front and two side portions wherein each portion is integral to one another and made of a resilient sheet material thereby forming a generally hollow rectangular cube exempt of a back and a bottom, base-engaging channels at each rear-most side edges of the primary cover adapted to slide vertically and longitudinally within the channels within the base, strikes for receiving each base latch whereby as the primary cover is slidably engaged within the base channels, the base engaging portions of the lower side portions of the primary cover ramps inwardly against the base lacking latch until such a time when the upper inner surface of the primary cover contacts the upper edge of the base and the locking latches and strikes align to allow the sides of the primary cover to spring outwardly thereby snapping the latched into the mating strikes, c. a secondary cover for covering the outlet when not in use having a top, a front and two side portions wherein each portion is integral to one another and made of a resilient sheet material thereby forming a generally hollow rectangular cube exempt of a back and a bottom, base-engaging channels at each rear-most side edges of the secondary cover adapted to slide vertically and longitudinally within the channels within the base, strikes for receiving each base latch whereby as the secondary cover is slidably engaged within the base channels, the base engaging portions of the lower side portions of the secondary cover ramps inwardly against the base lacking latch until such a time when the upper inner surface of the secondary cover contacts the upper edge of the base and the locking latches and strikes align to allow the sides of the secondary cover to spring outwardly thereby snapping the latched into the mating strikes.

2. The covers of the safety cover for an electrical outlet claim 1 wherein said covers are fabricated from a semi rigid yet resilient material having a generally good spring back memory.

3. The base of the safety cover for an electrical outlet claim 1 wherein said base is fabricated of a more rigid material than that of the covers.

4. The safety cover for an electrical outlet of claim 1 wherein the cover portions are adapted with T-shaped male channels that mate longitudinally with similarly oppositely shaped female grooves thereby allowing vertical longitudinal sliding action between the mating channels yet preventing any horizontal displacement.

5. The safety covers of claim 1 wherein a strike is provided to accept a latch from the base portion when the covers are slid downwardly.

6. The safety covers of claim 5 wherein said locked covers can only be removed by depressing the sidewall portions of the covers near the base inwardly to disengage the latch from the strike thereby allowing vertical upward displacement of the covers.

7. The base of the safety cover for an electrical outlet of claim 1 wherein the outlet openings may be adapted for the various outlet shapes and configurations.

8. The base or the safety cover for an electrical outlet of claim 1 wherein the upper edge of the base is provided with a dropped partial edge where the lower surface of the top of the covers shall positively stop, preventing the covers from continuing downwardly.

9. The latches of the base of the safety cover for an electrical outlet of claim 1 wherein the upper surface of each latch is tapered downwardly and inwardly so as to create an inward ramp effect when the lower edge of the covers abut said latch.

* * * * *